US005410995A

United States Patent [19]

Bentz et al.

[11] Patent Number: 5,410,995

[45] Date of Patent: May 2, 1995

[54] VALVE CROSSHEAD ASSEMBLY WITH WEAR-REDUCING CONTACT PAD

[75] Inventors: Joseph C. Bentz; John T. Carroll, III, both of Columbus, Ind.; Katsuhiro Shinosawa, Tokyo, Japan

[73] Assignee: Cummins Engine Company, Inc., Columbus, Ind.

[21] Appl. No.: 228,342

[22] Filed: Apr. 15, 1994

[51] Int. Cl.[6] ..... F01L 1/26

[52] U.S. Cl. ..... 123/90.22; 123/90.4; 74/559

[58] Field of Search ..... 123/90.22, 90.39, 90.4; 74/519, 559

[56] References Cited

U.S. PATENT DOCUMENTS

| | | | |
|---|---|---|---|
| 2,385,959 | 10/1945 | Yingling | 123/90.22 |
| 4,325,647 | 4/1982 | Maier et al. | 403/29 |
| 4,366,785 | 1/1983 | Goloff et al. | 123/90.51 |
| 4,794,894 | 1/1989 | Gill | 123/90.61 |
| 4,833,977 | 5/1989 | Haahtela et al. | 92/212 |
| 4,838,218 | 6/1989 | Sato et al. | 123/188 AA |
| 4,840,150 | 6/1989 | Kotzab et al. | 123/90.39 |
| 4,848,286 | 7/1989 | Bentz | 123/90.61 |
| 4,922,867 | 5/1990 | Mathews | 123/90.22 |
| 4,995,281 | 2/1991 | Allor et al. | 74/559 |
| 5,150,672 | 9/1992 | Fischer et al. | 123/90.22 |
| 5,211,143 | 5/1993 | Fontichiaro et al. | 123/90.39 |
| 5,236,274 | 8/1993 | Taniguchi | 123/90.4 |
| 5,279,211 | 1/1994 | Bentz et al. | 92/248 |

*Primary Examiner*—Willis R. Wolfe
*Assistant Examiner*—Weilun Lo
*Attorney, Agent, or Firm*—Sixbey, Friedman, Leedom & Ferguson

[57] ABSTRACT

In accordance with preferred embodiments of the invention, a disc-shaped contact pad of ceramic material is disposed within a recess formed in the top surface of a metal valve crosshead. The pad is held in the recess by a retainer that clips onto the crosshead. The retainer is designed to maintain only a light pressure on only a narrow shoulder of the pad to keep it seated, and does not, itself, experience any dynamic loading. Furthermore, by the provision of a circumferential clearance between the pad and both the wall of the crosshead recess and the retainer, the need for precision machining of the ceramic material can be avoided. Additionally, a reduction of frictional sliding forces imposed on the crosshead, and in turn upon the valves, by the rocker lever is achieved by the ceramic pad, so that resultant frictional side loading is not imposed on adjacent valve components to a significant extent.

22 Claims, 6 Drawing Sheets

VALVE CROSSHEAD ASSEMBLY WITH WEAR-REDUCING CONTACT PAD

BACKGROUND OF THE INVENTION

1. Field of the Invention

The present invention relates to valve crosshead assemblies which carry valves of an internal combustion engine, and which are acted upon by the valve rocker levers of the valve drive train. The present invention also relates to the use of ceramic materials to provide wear-resistant contact surfaces for internal combustion engine components.

2. Description of Related Art

The harsh operating conditions encountered in an internal combustion engine, particularly the high temperatures and high pressures, cause engine components to wear rapidly. Mechanically driven actuators and actuating components are especially susceptible to wear in this environment. Consequently, the materials used for producing actuating engine components should provide good mechanical strength, thermal stability and wear resistance. While metals have typically been used to form such components, ceramics, such as zirconia, silicon nitride, silicon carbide and the like, have been found to exhibit excellent mechanical strength, thermal stability and improved wear resistance relative to metals. As a result, ceramics are increasingly being used as structural materials for components of gas turbine engines and diesel engines.

However, even though ceramics can provide highly wear-resistant engine components, they are generally hard and brittle and lack the formability and workability of the metals which are conventionally applied to low cost precision engine components. Furthermore, while components formed from a ceramic element and a metal element have been proposed to overcome these limitations, and components of this type that can be useful as internal combustion engine components are available, composite components formed of metal and ceramic elements are not without their own problems. The low thermal expansion and tensile strength properties of structural ceramics relative to metals, in general, make formation of a secure connection between these two elements difficult to achieve. Presently, each element is machined to produce tolerances that are not only sufficiently precise to ensure the retention of the ceramic element in the metal element during engine operation, but which also allow for the differential thermal expansion of the ceramic and the metal, and limit tensile stresses in the ceramic.

In the case of the cylinder head valve drive train of an internal combustion engine, a push rod used to transmit movement of a cam to a valve rocker lever, which acts on a crosshead to which cylinder head valves are mounted, is known to be formed of a composite metal and ceramic component in which a ball and socket component is joined to a hollow tube using interference fit methods as is disclosed in U.S. Pat. No. 4,794,894 to Gill, and U.S. Pat. No. 4,806,040 to Gill et al., both assigned to Cummins Engine Company, Inc., assignee of the present invention. U.S. Pat. No. 4,848,286 to Bentz, also assigned to Cummins Engine Co., discloses the use of an external metal connector for joining ceramic and metal components of a pivot rod.

Additionally, a lightweight metal rocker arm having a wear-resistant, cam-engaging pad formed of a ceramic material is disclosed in U.S. Pat. No. 4,995,281 to Allor et al. The ceramic pad is, preferably, integrally joined to the rocker arm during casting of the rocker arm but it is also indicated that it could be affixed after forming by such other techniques as adhesive bonding, brazing, or interference fitting.

In Sato et al. U.S. Pat. No. 4,838,218, a ceramic valve is joined to a metal spring retainer via a tapered metal cotter. The metal cotter is tightly engaged between the stem of the ceramic valve and a tapered annular inner wall of the retainer, and to minimize the chance of resulting stress concentrations in the ceramic valve stem, a stress relief coating or layer is applied to the surface of the cotter which engages the valve stem.

Apart from uses in a cylinder valve drive train, use of an interference fit to secure a ceramic component to a metal component to form a composite structure useful in an internal combustion engine is also shown in U.S. Pat. No. 4,366,785 to Goloff et al., for example. This patent discloses a tappet for an internal combustion engine with a ceramic wear resistant insert maintained within the annular metal rim of the main body of the tappet by an interference fit. The wear resistant insert is formed to be slightly larger in diameter than the diameter of the recess into which it is fitted. The ceramic insert is forced into the recess under sufficient pressure to press fit it in the tappet main body. The insert is not required to be sized to fit exactly within the recess in the tappet, but must be slightly larger than the recess. However, to provide a secure interference fit without damaging the metal or ceramic components, each must still be formed to close tolerances.

With respect to a piston for an engine cylinder, U.S. Pat. No. 4,325,647 to Maier et al. discloses a method of securing a ceramic wear resistant element to a metal element using a separate connecting element formed from an insulating resilient body of a ceramic material by which thermally induced differences between the ceramic and metal. structures are equalized, and contact stress in the operating state is limited. The insulating body positively connects the ceramic and metallic elements and operates effectively to secure these elements when it has specific physical characteristics, for example, a thermal conductivity of 0.02 to 0.25 W/cmK at a temperature difference between the ceramic and the metallic structural elements of about 100° to 1500° C. and an elastic modulus of about 5000 and 150,000 $N/mm^2$. This composite, however, is not intended to be used for a sliding friction interface between mechanically driven valve actuating components.

Also, external connectors have been proposed for joining a ceramic element to a metal element of a piston. U.S. Pat. No. 4,833,911 to Haahtela discloses a ceramic piston ring carrier held in place on a metal piston by casting in or with a locking ring to improve force transmission and frictional conditions between the piston and the cylinder. However, this patent does not suggest how that arrangement described therein could be used to secure a ceramic element to a metal element to form a wear-resistant interface between engine valve actuating components where sliding friction is a significant factor.

Lastly, commonly assigned, U.S. Pat. No. 5,279,211, two of the inventors of which are the inventors of the present invention, internal combustion engine actuator or actuating components, such as compression brake master pistons and hydraulic tappet sliding cam followers, are formed of a composite structure of metal and ceramic members which minimizes tensile ceramic loads and accommodates differences in thermal expansion characteristics between the metal member and the ceramic member without reliance on precise physical control of the dimensions of either member. The composite component includes a mechanical retainer which allows a loose fitting relationship between the metal and ceramic members. The ceramic member is secured within a receiving bore in the metal member by the retainer in a manner which eliminates the need for precise machining of the ceramic and metal members. The metal member may be configured to accept either an internal or an external mechanical retainer element.

However, despite the extensive use in the prior art of engine components formed of united ceramic and metal elements, no arrangement has yet been devised in which a ceramic sliding friction wear element is provided for a valve crosshead that is engaged by a valve rocker lever, and in particular, in a manner directed to the specific needs of and which will be sufficiently reliable when used for a valve crosshead. In particular, no metal valve crosshead has been provided with a ceramic insert which will not only reduce frictional wear but also energy loss from contact by the rocker lever and friction induced side loads, while still being capable of commercially feasible, inexpensive, high volume production.

SUMMARY OF THE INVENTION

Therefore, it is a primary object of the present invention to provide a reliable, wear-resistant metal valve crosshead having a ceramic insert which will not only reduce frictional wear but also energy loss from contact by the rocker lever and friction induced side loads.

It is another object of the present invention to provide a metal valve crosshead having a ceramic insert wherein the ceramic insert is loosely retained in a metal element in a manner enabling the insert to move laterally with respect to the crosshead.

Yet another object of the present invention is to provide a valve crosshead which will attain the foregoing objects while still being capable of commercially feasible, inexpensive, high volume production.

These and other objects are obtained, in accordance with preferred embodiments of the invention, by disposing a disc-shaped wear pad of ceramic material within a recess formed in the top surface of the metal valve crosshead. The pad is held in the recess by a retainer that clips onto the crosshead. The retainer is designed to maintain only a light pressure on only a narrow shoulder of the pad to keep it seated, and does not, itself, experience any dynamic loading. Furthermore, by the provision of a circumferential clearance between the pad and both the wall of the crosshead recess and the retainer, the need for precision machining of the ceramic material can be avoided. Additionally, a reduction of frictional sliding forces imposed on the crosshead, and in turn upon the valves, by the rocker lever is achieved by the ceramic pad, so that resultant frictional side loading is not imposed on adjacent valve components to a significant extent.

In this regard, it is noted that parasitic horsepower loss due to friction between a conventional metal rocker lever nose and a metal crosshead is significant because an engine uses multiple crossheads, e.g., in a 4-valve per cylinder engine there are two crossheads per cylinder, so that in a 6-cylinder engine there would be twelve crossheads with twelve rocker lever-crosshead frictional interfaces. Moreover, it has been found that the reduced friction achieved at each lever-crosshead interface by the use of a ceramic pad in accordance with the present invention achieves a two-fold frictional horsepower loss reduction. Firstly, parasitic horsepower loss associated with the frictional conversion of energy to heat is reduced at each lever-crosshead interface. Furthermore, the reduced side loading imposed on the valve stems reduces the sliding friction of the valve stem against the valve guide bore as the valve stem slides up and down during valve operation, thereby reducing the parasitic horsepower loss due to frictional conversion of energy to heat at the valve guide bores. In a particularly preferred embodiment, the ceramic pad is given a noncircular shape to prevent it from rotating in its receiving pocket of the crosshead, thereby reducing sliding wear between the crosshead and the ceramic pad as well.

These and further objects, features and advantages of the present invention will become more apparent from the following description when taken in connection with the accompanying figures of the drawings which, for purposes of illustration only, show several embodiments in accordance with the present invention.

Throughout the figures, like numerals are used to indicate corresponding components of the various embodiments with prime (') and double-prime (") designations being using to distinguish elements of the second and third embodiments which have been modified relative to the corresponding parts of the first embodiment.

DETAILED DESCRIPTION OF THE PREFERRED EMBODIMENTS

Figure 1:
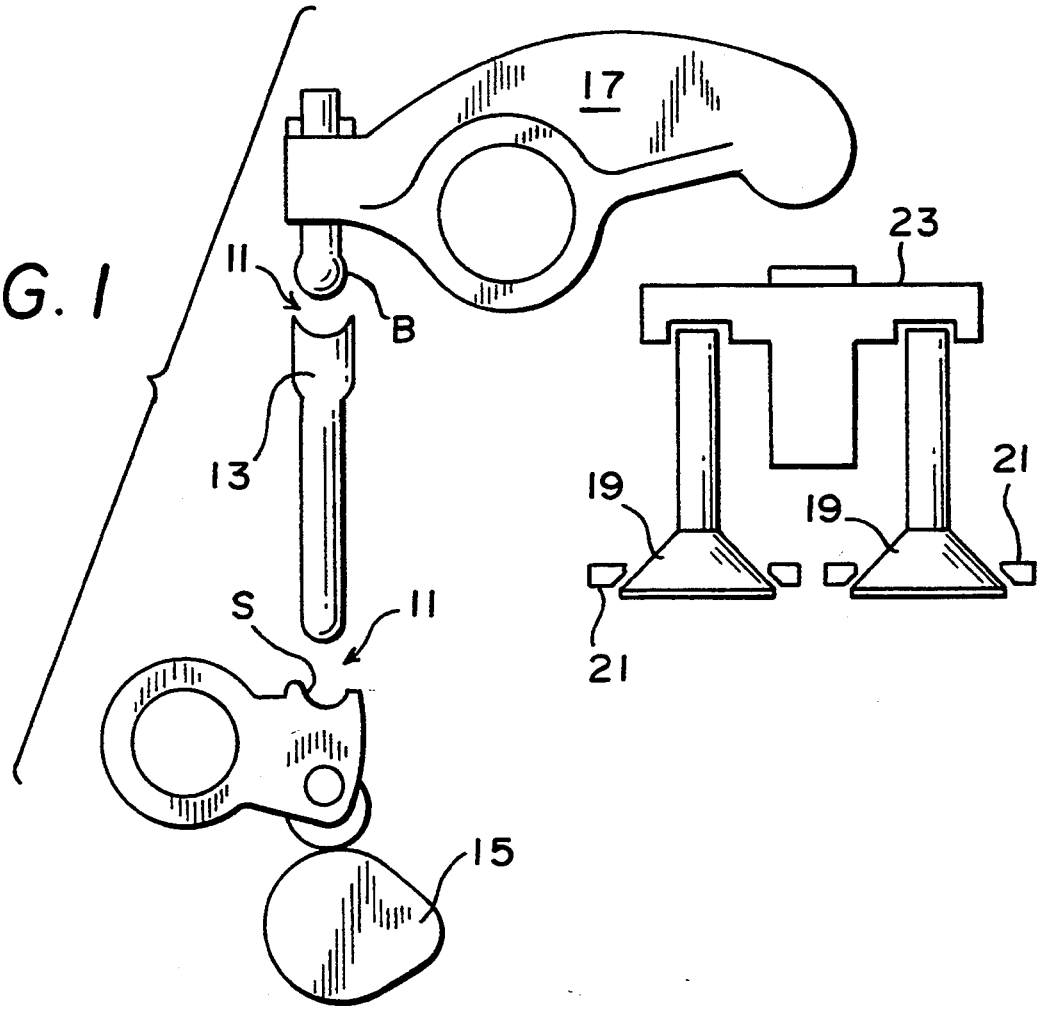
FIG. 1 schematically depicts an engine cylinder head valve drive train of the type in which the valve crosshead assembly of the present invention is used.
Figure 2:
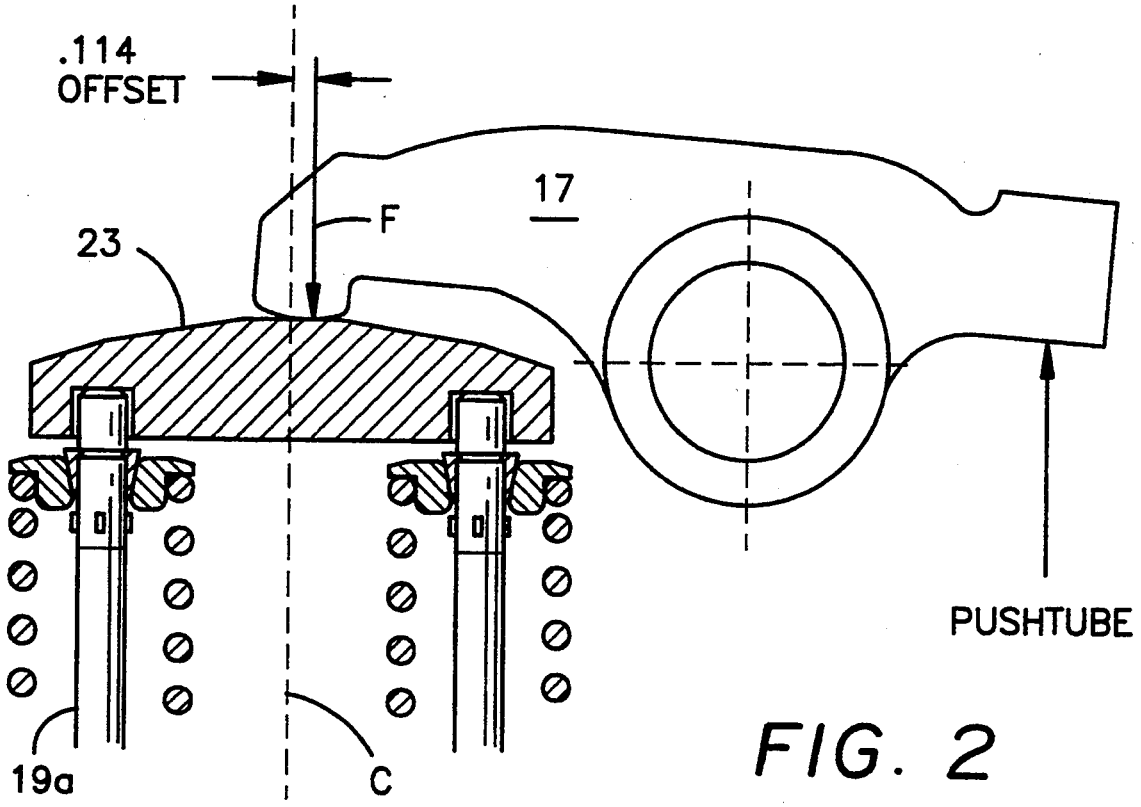
FIGS. 2–5 depict the location of contact between a valve rocker lever and a valve crosshead at various points in the opening and closing cycles of engine exhaust and intake valves.
Figure 3:
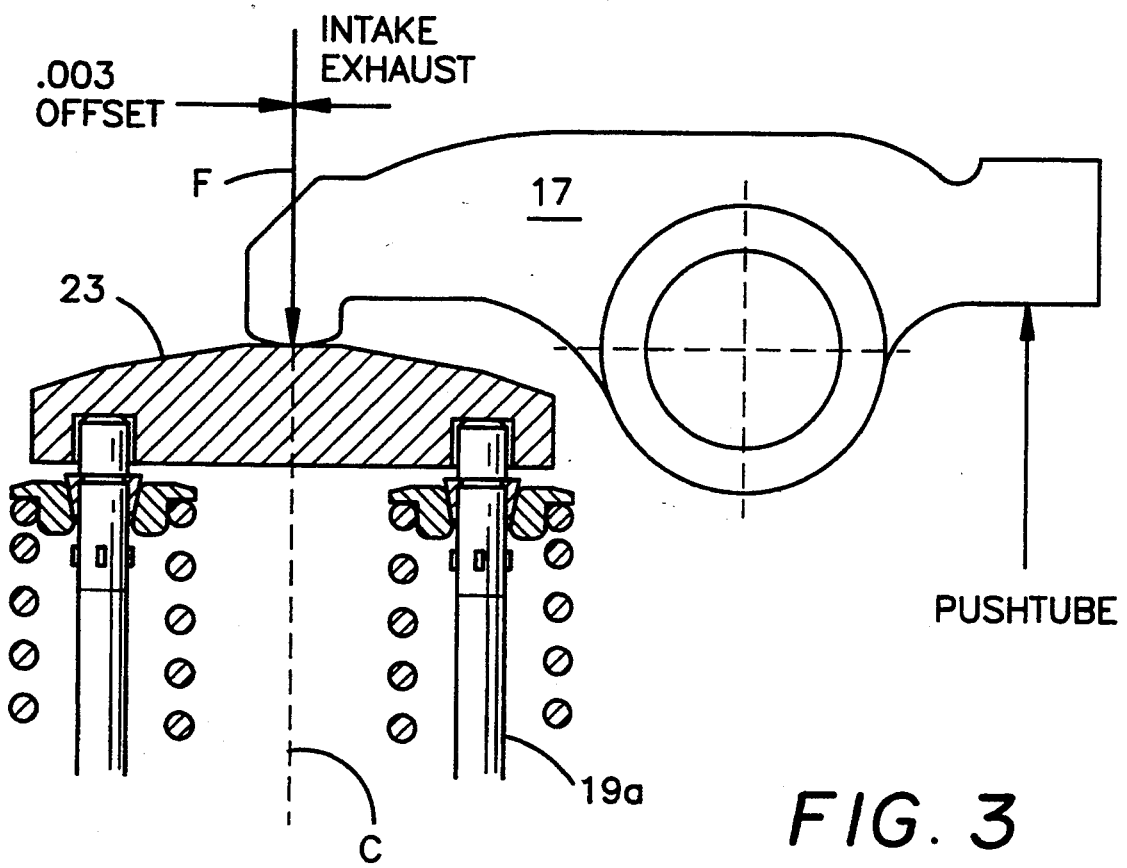

FIG. 1 depicts an engine cylinder head valve drive train wherein ball and socket joints 11 are provided at each of opposite ends of a push rod 13 that is used to transmit movement produced by a cam 15 to a valve rocker lever 17. Movement of the valve rocker lever 17, produced by the cam 15 and push rod 13, in turn, seats and unseats engine cylinder valves 19 with respect to valve seats 21 by acting on valve crosshead 23. To the extent described so far, this engine cylinder head valve drive train is conventional.

Figure 4:
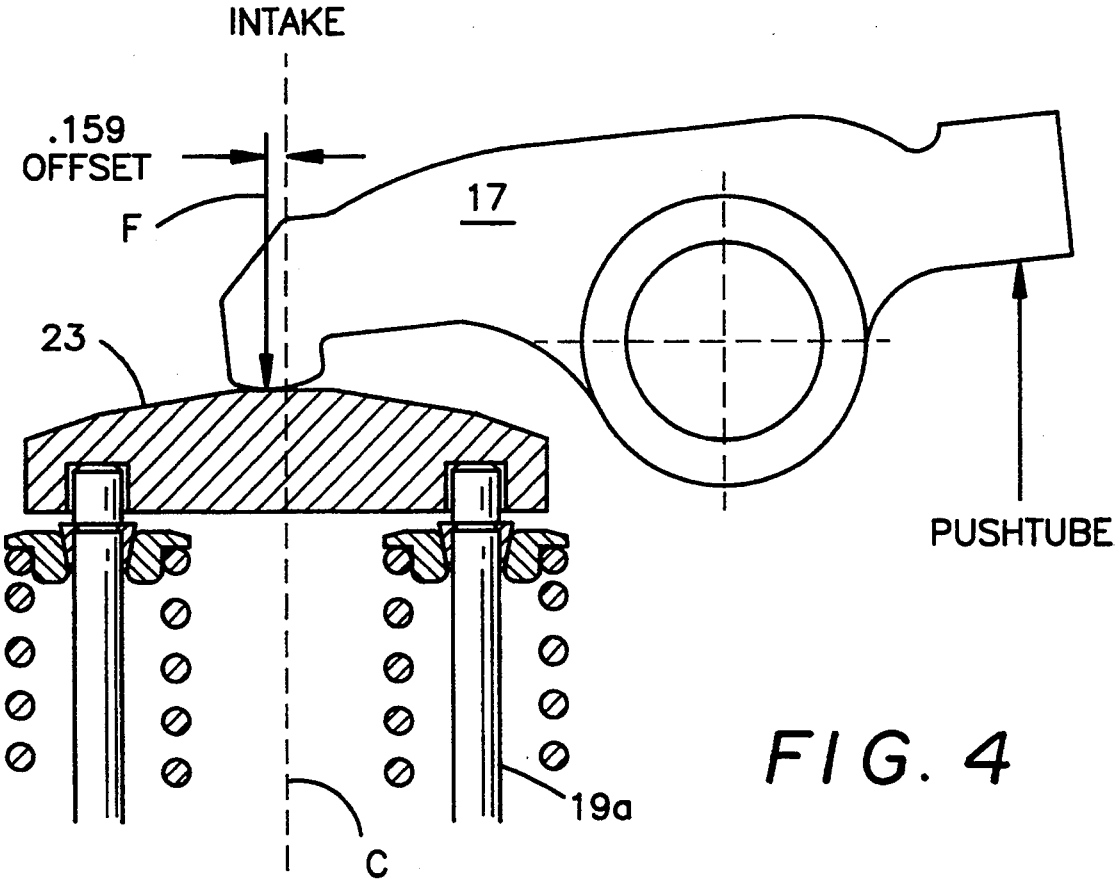
Figure 5:
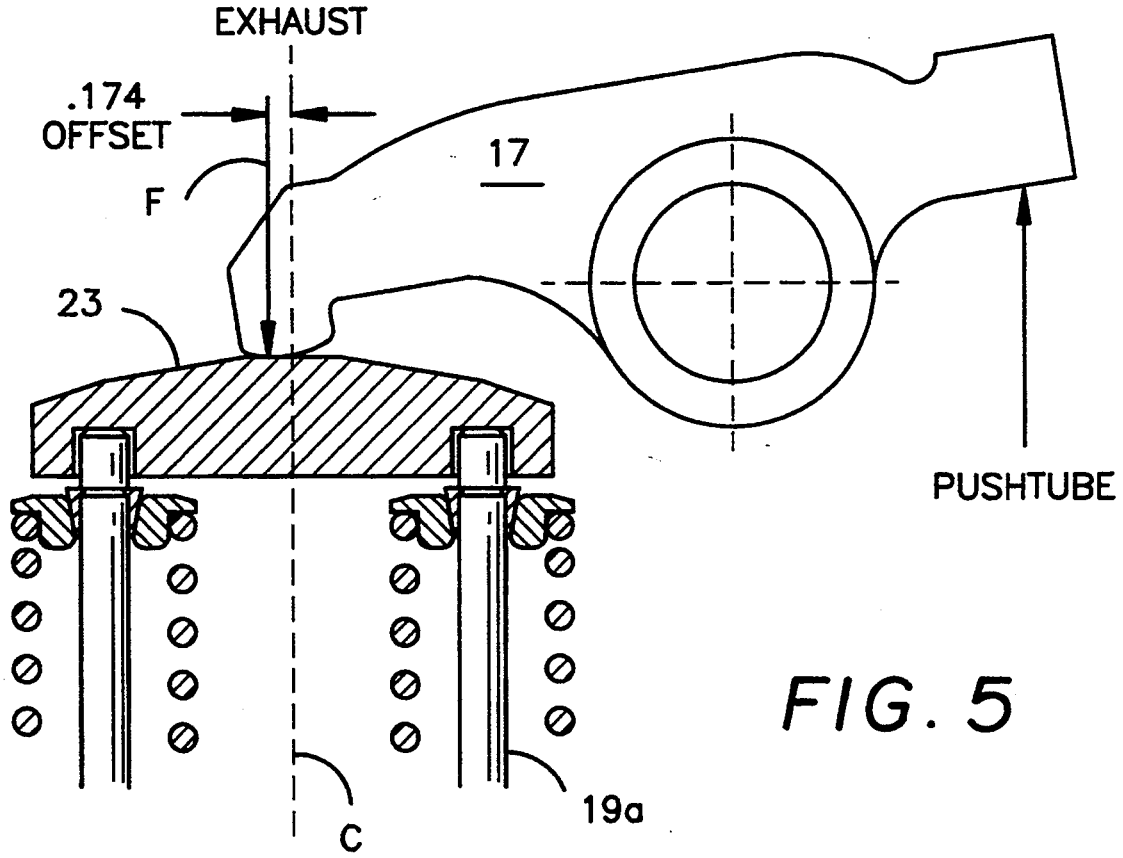

As can be seen from FIGS. 2–5, which show, for one example, the position of the rocker lever 17 relative to the valve crosshead 23 for intake and exhaust loads at zero lift (FIG. 2), for intake and exhaust loads at one-third lift (FIG. 3), intake loads at full lift (FIG. 4), and exhaust loads at full lift (FIG. 5), except at a position where the valves are at a position of one-third lift (FIG. 3), the dynamic forces imposed by the rocker lever 17 on the crosshead 23 are not centered relative to the crosshead centerline represented by dashed line C. Furthermore, it has been determined that, as can be seen by the line of action of these dynamic forces represented by arrow F, these forces act on the rocker lever 23 at a point that moves back and forth between an inboard side of centerline C (FIG. 2) and an outboard side thereof (FIGS. 4 & 5). As a result, bending moments are created due to the frictional forces between rocker lever 17 and the crosshead 23, which forces have been found to increase as the rocker lever 17 wears and are a major factor in fatigue failure of the stem 19*a* of the valves 19.

Figure 6:
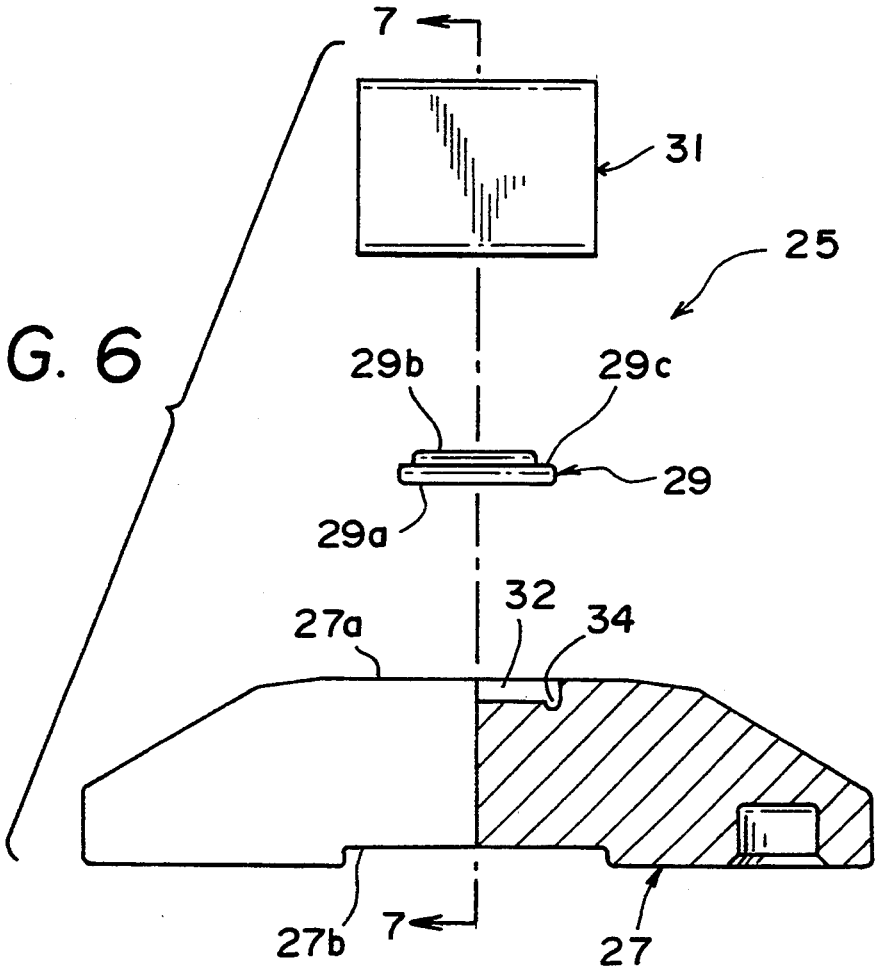
FIG. 6 is an exploded, partial sectional, view of a valve crosshead assembly in accordance with a preferred embodiment of the present invention.

Thus, to reduce frictional wearing of the rocker lever 17 and friction induced side loading of the crosshead 27, which can lead to fatigue failure of the valve stem 19*a*, the crosshead 23 of the illustrated drive train has been modified from that of the prior art. In particular, the crosshead 23, in accordance with the invention, comprises an assemblage of metal and ceramic components. In particular, the valve crosshead assembly 25, as illustrated in FIG. 6, includes a valve crosshead 27, a contact pad 29 and a retainer 31. The crosshead 27 is formed of metal, e.g., cold formed and heat treated 8620 steel, the contact pad 29 is manufactured from ceramic powders, e.g., silicon nitride powders that are die pressed and pressureless sintered, and the retainer 31 is formed, e.g., by being stamped from flat stock, of spring steel.

To receive the contact pad 29, the crosshead 27 has a recess 32 formed in its top surface. Recess 32 has a diameter which is sufficiently larger than that of the contact pad 29 to insure that the contact pad 29 is loosely received therein despite manufacturing tolerances, i.e., given the usual manufacturing tolerances, a largest possible contact pad 29 within its tolerance range may simply be dropped within a smallest possible recess 32 within its tolerance range without the application of force (e.g., with a 0.1 mm tolerance for the ceramic pad 29 and 0.05 mm tolerance for the diameter of recess 32 in metal crosshead 27, pad 29 would have a design size that is at least 0.15 mm smaller than the diameter of recess 32). Furthermore, instead of providing a radiused curve between the bottom and side walls of the recess 32, a rounded groove 34 is provided at the junction of the bottom and side walls of the recess 32. In this way, it can be assured that the flat bottom of the contact pad 29 will rest flush upon the bottom wall of the recess 32, even if the contact pad 29 adjoins the side wall of the recess 32. In contrast, with a normal radiused curve, it is possible for the contact pad to ride up the radiused curve, resulting in lifting of that portion of the contact pad 29, tilting of the contact pad in a way that could affect valve operation.

Figure 7:
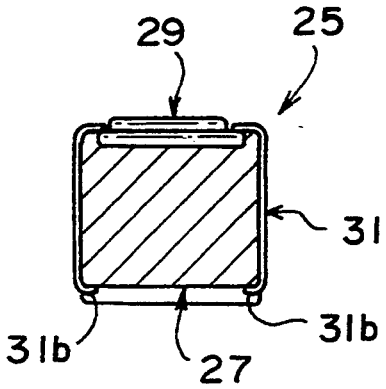
FIG. 7 is a cross-sectional view taken along line 7—7 of FIG. 6 but with the parts in their assembled condition.

As can be seen from FIGS. 6 and 7, contact pad 29 is disc-shaped having a base portion 29*a* and a reduced diameter contact portion 29*b*. Base portion 29*a* loosely fits within recess 32, as described above, and has a thickness which is at most only slightly larger than the depth of recess 32, and which can be less. The overall height of the contact pad 29 is such that the contact portion 29*b* projects above the top surface 27*a* by, for example, approximately 1 min.

Figure 8:
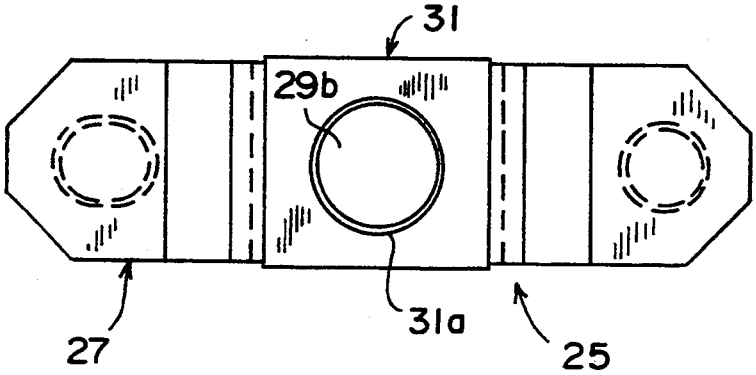
FIG. 8 is a top view of the assembled valve crosshead assembly.
Figure 9:
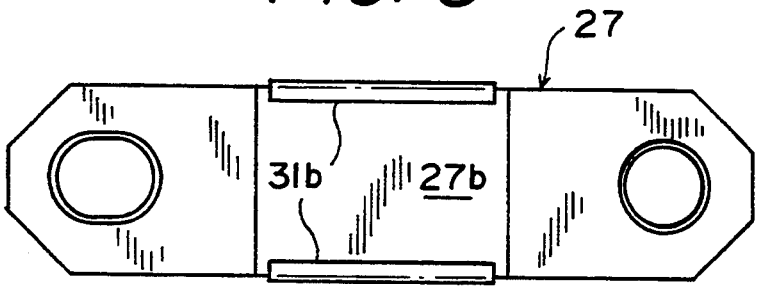
FIG. 9 is a bottom view of the assembled valve crosshead assembly.

Retainer 31 is in the form of a spring clip that can be snapped onto the crosshead 27 in a position overlying the recess 32, and has an opening 31*a* (FIG. 8) that is smaller than the outer diameter of base portion 29*a* of the contact pad 29, yet is larger than the diameter of contact portion 29*b*. In this way, the shoulder 29*c* of contact pad 29, formed by the top surface of base portion 29*a*, will be restrained from movement out of the recess 32 by the retainer 31, and the contact portion 29*b* can extend through the opening 31*a* with clearance, as apparent from FIGS. 7 and 8, to provide a low-friction, wear-resistant contact surface for the valve rocker lever 17. Preferably, retainer 31 maintains a light pressure on shoulder 29*c* to keep the contact pad 29 seated in recess 32 while allowing some lateral play. Retainer 31, itself, is held onto the crosshead 27 by inwardly bent ends 31*b* thereof which engage themselves on the bottom of a notch 27*b* that is formed in the underside of the crosshead 27, as shown in FIGS. 7 and 9.

Figure 15:
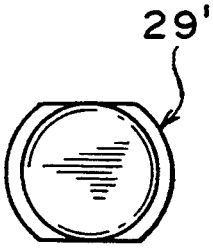
FIGS. 15 & 16 are top and side views of the contact pad of the valve crosshead assembly of FIG. 11.
Figure 16:
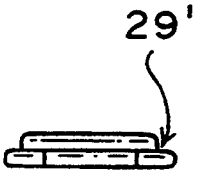

FIGS. 10–16 show two modified embodiments that are particularly suited for situations where the rocker lever must be scalloped at one side, for example, to accommodate the diameter of a fuel injector spring. In the case of the FIG. 10 embodiment, the valve crosshead assembly 25 has a rocker lever 27' which has a scallop 34 at one side. Contact pad 29' is shaped as shown in FIGS. 15 and 16 to accommodate the scallop 34 by being truncated at opposite lateral sides, and the recess 32 in which it is received is similarly modified, to avoid having to substantially reduce the size of the contact portion 29'*b*. In the case of the FIG. 11 embodiment, to minimize edge stresses by enabling a larger contact portion 29''*b* to be provided, the side of the contact portion 29''*b* adjacent the scallop 34 is also scalloped. The use of a rotationally asymmetric contact pad 29', 29'' has the added advantage of precluding relative rotation between the contact pad 29', 29'' and the crosshead 31' and thereby reducing sliding wear therebetween.

Figure 10:
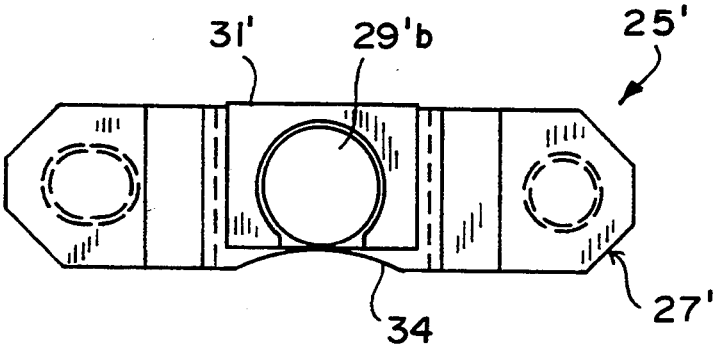
FIGS. 10 & 11 are top views corresponding to that of FIG. 8 but of two modified valve crosshead assemblies.
Figure 11:
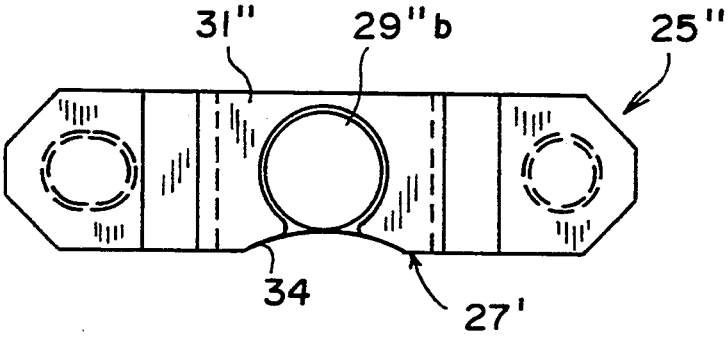
Figure 12:
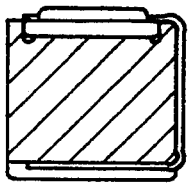
FIG. 12 is a cross-sectional view corresponding to that of FIG. 7 but of the crosshead assemblies of FIGS. 10 & 11.
Figure 13:
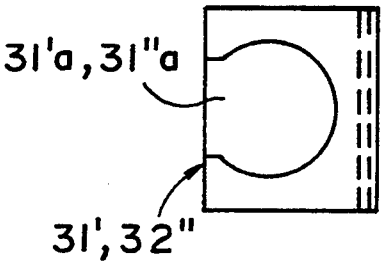
FIGS. 13 & 14 are top and side views of the retainer of the valve crosshead assemblies of FIGS. 10 & 11.
Figure 14:
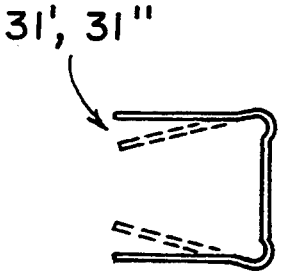

To hold the contact pad 29', 29'' in place, a modified retainer 31, 31'' is utilized which, unlike retainer 31, is side-mounted instead of being top-mounted, as is particularly apparent from FIG. 12. As can be seen from FIG. 14, has an unstressed condition in which the free ends of its legs approach each other, as represented in broken lines. Thus, when the retainer 31', 31'' is mounted on the rocker lever 27', its legs are flexed outwardly into their solid-line position, and thus, are resiliently stressed sufficiently to hold the retainer 31', 31'' in place. Additionally, as can be seen in FIGS. 10, 11 & 13, retainer opening 31'*a*, 31''*a* is open in the area where the contact pad 29'*b*, 29''*b* adjoins the scallop 34.

While various embodiments in accordance with the present invention have been shown and described, it is understood that the invention is not limited thereto, and is susceptible to numerous changes and modifications as known to those skilled in the art. For example, while the preferred ceramic material for the contact pad has been indicated to be silicon nitride, other ceramic materials, such as alumina, zirconia, and zirconium alumina composites may be used. Therefore, this invention is not limited to the details shown and described herein, and includes all such changes and modifications as are encompassed by the scope of the appended claims.

Industrial Applicability

The valve rocker assembly of the present invention will find utility with respect to a wide variety of engine valve train types, and especially, those where wear and frictional side loading effects due to contact between the rocker lever and valve crosshead are found to be problematic. The present invention will also be found to be helpful in reducing parasitic power loss, thereby offering an opportunity to obtain improved fuel economy.

We claim:

1. Valve crosshead assembly comprising a crosshead formed of metal having a recess in a top surface thereof, a disc-shaped contact pad formed of a ceramic material loosely disposed in said recess, and a resilient retainer clipped onto a top portion of the crosshead in a position partially overlying said recess and a portion of a top surface of the contact pad as a means for loosely retaining the contact pad in said recess.

2. Valve crosshead assembly according to claim 1, wherein the ceramic material of which said disc-shaped contact pad is formed is silicon nitride.

3. Valve crosshead assembly according to claim 1, wherein said disc-shaped contact pad has a base portion which is disposed in said recess and a contact portion, the contact portion being smaller in area than said base portion and projecting therefrom above the top surface of the crossarm.

4. Valve crosshead assembly according to claim 3, wherein a shoulder is formed by a top surface of said base portion; and wherein said contact pad is retained in said recess by engagement of said resilient retainer on said shoulder.

5. Valve crosshead assembly according to claim 4, wherein said resilient retainer has a pair of legs at opposite sides of a connecting portion.

6. Valve crosshead assembly according to claim 5, wherein said connecting portion is disposed on the top surface of the crosshead and has an opening through which the contact portion of the contact pad passes.

7. Valve crosshead assembly according to claim 6, wherein each of said legs of the resilient retainer is disposed on a respective side of the crosshead and has a free end which is inwardly bent and is engaged on a bottom surface of the crosshead.

8. Valve crosshead assembly according to claim 7, wherein the bottom surface of the crosshead has a notched area in which the free ends of the legs of the resilient retainer is engaged.

9. Valve crosshead assembly according to claim 5, wherein said connecting portion is disposed on a side surface of the crosshead with said legs on top and bottom surfaces of the crosshead.

10. Valve crosshead assembly according to claim 9, wherein the leg of said resilient retainer that is on the top surface of said crosshead has an opening through which the contact portion of the contact pad passes.

11. Valve crosshead assembly according to claim 10, wherein a side of the crosshead opposite that on which said connecting portion is disposed is scalloped between said legs in proximity to said recess.

12. Valve crosshead assembly according to claim 11, wherein the base portion of the contact pad is truncated so as to eliminate said shoulder at each of opposite sides thereof, the truncated sides being retained in the recess of the crosshead so as to be closest to said sides of the crosshead.

13. Valve crosshead assembly according to claim 12, wherein the contact portion is scalloped in proximity to the scallop of the crosshead.

14. Valve crosshead assembly according to claim 13, wherein the opening in the resilient retainer is laterally open in a direction toward said scallop.

15. In an engine cylinder head valve drive train of the type wherein a cam-operated push rod transmits motion to a rocker lever formed of metal and the rocker lever seats and unseats cylinder valves by acting on a crosshead formed of metal, the improvement comprising the crosshead having a recess in a top surface thereof, a disc-shaped contact pad of ceramic material being loosely disposed in said recess, and a resilient retainer being clipped onto a top portion of the crosshead in a position partially overlying said recess and a portion of a top surface of the contact pad as a means for loosely retaining the contact pad in said recess.

16. An engine cylinder head valve drive train according to claim 15, wherein a valve stem of a cylinder valve is attached to said crosshead at each of opposite sides of said disc-shaped contact pad.

17. An engine cylinder head valve drive train according to claim 16, wherein said disc-shaped contact pad has a base portion which is disposed in said recess and a contact portion, the contact portion being smaller in area than said base portion and projecting therefrom above the top surface of the crossarm; wherein a shoulder is formed by a top surface of said base portion; and wherein said contact pad is retained in said recess by engagement of said resilient retainer on said shoulder.

18. An engine cylinder head valve drive train according to claim 17, wherein said resilient retainer has a pair of legs at opposite sides of a connecting portion; wherein said connecting portion is disposed on a side surface of the crosshead with said legs on top and bottom surfaces of the crosshead.

19. An engine cylinder head valve drive train according to claim 18, wherein the leg of said resilient retainer that is the top surface of said crosshead has an opening through which the contact portion of the contact pad passes; wherein a side of the crosshead opposite that on which said connecting portion is disposed is scalloped between said legs in proximity to said recess; and wherein the base portion of the contact pad is truncated so as to eliminate said shoulder at each of opposite sides thereof, the truncated sides being retained in the recess of the crosshead so as to be closest to said sides of the crosshead.

20. Valve crosshead assembly according to claim 19, wherein the contact portion is scalloped in proximity to the scallop of the crosshead; and wherein the opening in the resilient retainer is laterally open in a direction toward said scallop.

21. Valve crosshead assembly comprising a crosshead formed of metal having a solid central portion within a top surface of which a shallow recess is formed, a thin disc-shaped contact pad formed of a ceramic material loosely disposed in said recess with a circumferential clearance between the contact pad and a facing wall of the recess, and a resilient retainer externally clipped onto the crosshead in a position partially overlying an open side of said recess and surface areas of the contact pad facing outwardly relative to said open side of the recess, a circumferential clearance existing between the contact pad and the retainer, whereby said retainer forms a means for retaining the contact pad in said recess without dynamic loading of the retainer by the contact pad.

22. In an engine cylinder head valve drive train of the type wherein a cam-operated push rod transmits motion to a rocker lever formed of metal and the rocker lever seats and unseats cylinder valves by acting on a crosshead formed of metal, the improvement comprising the crosshead having a solid central portion within a top surface of which a shallow recess is formed a thin disc-shaped contact pad formed of a ceramic material being loosely disposed in said recess with a circumferential clearance between the contact pad and a facing wall of the recess, and a resilient retainer externally clipped onto the crosshead in a position partially overlying an open side of said recess and Surface areas of the contact pad facing outwardly relative to said open side of the recess, a circumferential clearance existing between the contact pad and the retainer, whereby said retainer forms a means for retaining the contact pad in said recess without dynamic loading of the retainer by said valve drive train during operation thereof.

* * * * *